US007812234B2

(12) United States Patent
Dybas

(10) Patent No.: US 7,812,234 B2
(45) Date of Patent: Oct. 12, 2010

(54) MULTIPLE PICK STRUCTURE FOR STRINGED INSTRUMENTS

(76) Inventor: Robert Dybas, 4506 W. 100th Pl., Oak Lawn, IL (US) 60453

( * ) Notice: Subject to any disclaimer, the term of this patent is extended or adjusted under 35 U.S.C. 154(b) by 0 days.

(21) Appl. No.: 12/384,951

(22) Filed: Apr. 10, 2009

(65) Prior Publication Data

US 2009/0293700 A1 Dec. 3, 2009

Related U.S. Application Data

(63) Continuation-in-part of application No. PCT/US2007/021514, filed on Oct. 9, 2007.

(60) Provisional application No. 60/851,087, filed on Oct. 11, 2006.

(51) Int. Cl.
*G10D 3/16* (2006.01)

(52) U.S. Cl. ..... 84/322; 84/320

(58) Field of Classification Search ..... 84/320, 84/322

See application file for complete search history.

(56) References Cited

U.S. PATENT DOCUMENTS

| | | | | | |
|---|---|---|---|---|---|
| 768,241 | A * | 8/1904 | Seidel | 84/322 |
| 1,184,561 | A * | 5/1916 | Napoletano | 84/322 |
| 1,557,476 | A * | 10/1925 | Kimball et al. | 84/322 |
| 2,221,234 | A * | 11/1940 | Frasier | 84/322 |
| 3,112,668 | A * | 12/1963 | Moshay | 84/322 |
| 3,304,826 | A * | 2/1967 | Conradin | 84/322 |
| 3,312,137 | A * | 4/1967 | Oddo | 84/322 |
| 4,248,128 | A * | 2/1981 | Des Gaines | 84/322 |
| 4,651,614 | A * | 3/1987 | Cavallo | 84/322 |
| 4,790,227 | A * | 12/1988 | Lukehart | 84/322 |
| 4,867,032 | A * | 9/1989 | Lukehart | 84/322 |
| 5,253,562 | A * | 10/1993 | Kline | 84/322 |
| 5,483,859 | A * | 1/1996 | Singer | 84/322 |
| D369,615 | S * | 5/1996 | Latteri | D17/20 |
| 5,594,189 | A * | 1/1997 | Latteri | 84/322 |
| 6,215,052 | B1 * | 4/2001 | Giddens et al. | 84/329 |
| 6,225,539 | B1 * | 5/2001 | Freeman | 84/322 |
| 6,342,661 | B1 * | 1/2002 | Flamm | 84/322 |

(Continued)

FOREIGN PATENT DOCUMENTS

GB 2347550 A * 9/2000

(Continued)

*Primary Examiner*—Jeffrey Donels
*Assistant Examiner*—Robert W Horn
(74) *Attorney, Agent, or Firm*—Chapman and Cutler LLP

(57) ABSTRACT

A multiple part pick for engaging strings of a stringed musical instrument has a first part with a first blade for engaging the strings, a second part having a second blade for engaging the strings, and means for slidable connection between the first part and the second part for relative movement between the two parts. The blades of the two parts are mounted for a relative sliding movement accomplished by relative movement of the musician's fingertips, so that a musician can selectively choose which blade to use to engage with the strings without interrupting a musical performance. Different playing qualities among the blades allow the musician to produce different sound qualities without interrupting performance. In additional embodiments, added optional features include a third blade, a holder part, or a peg and channel feature, to keep parts from disengaging with one another during performance, or a gripping portion to prevent slippage.

13 Claims, 6 Drawing Sheets

U.S. PATENT DOCUMENTS

| | | | | |
|---|---|---|---|---|
| 6,815,597 | B1 * | 11/2004 | Bosley | 84/322 |
| D577,379 | S * | 9/2008 | Morris | D17/20 |
| 7,459,620 | B1 * | 12/2008 | Kester | 84/320 |
| 7,589,267 | B1 * | 9/2009 | Sims | 84/320 |
| 2005/0223872 | A1 * | 10/2005 | Greenwald | 84/322 |
| 2008/0110319 | A1 * | 5/2008 | Morris | 84/320 |
| 2009/0293700 | A1 * | 12/2009 | Dybas | 84/322 |
| 2010/0083811 | A1 * | 4/2010 | Gsell | 84/322 |

FOREIGN PATENT DOCUMENTS

| | | | |
|---|---|---|---|
| GB | 2348536 | A * | 10/2000 |
| GB | 2400227 | A * | 10/2004 |

* cited by examiner

MULTIPLE PICK STRUCTURE FOR STRINGED INSTRUMENTS

This is a continuation-in-part of International Application PCT/US2007/021514 with an international filing date of Oct. 9, 2007, the contents of which are incorporated herein by reference, and in which priority is claimed to U.S. Provisional Pat. App. Ser. No. 60/851,087 filed on Oct. 11, 2006, the contents of which are incorporated herein by reference.

TECHNICAL FIELD OF THE INVENTION

This invention relates to picks for use with stringed musical instruments.

BACKGROUND ART

Many proposals have been made for pick designs to be used on stringed musical instruments, such as guitars, mandolins and banjos. Typically, the strings are actuated to cause one or more strings thereof to vibrate to produce musical tones from the instrument. Conventional picks are well known and manually used by the musician to "pluck" the strings. In chording, a single pick is rapidly, sequentially moved across all of the strings of the instrument, causing them to vibrate and each produce its own musical tone in accordance with its tension and length. With proper tuning and fingering, a musical "chord" results. Alternatively, a pick may be used with an individual string so that individual tones are produced.

DISCLOSURE OF THE INVENTION

Summary of the Invention

Conventional picks are generally triangular in shape, are made of plastic, and are available in different sizes and "weights" or gauges. The term "weight" or "gauge" as used by musicians refers to the thickness or rigidity of the pick. Typically, if a musician wants to switch to a different "gauge" pick, he has to stop playing briefly to exchange one pick for another. However, it is often desirable to be able to quickly switch between picks of different weight without interrupting the flow of a particular musical composition.

Accordingly, it is the object of this invention to provide a multi-pick structure that is simple and easy to use and permits the musician to quickly switch between different weight picks.

It is a further object of the invention to provide a multi-pick structure, whereby simple relative movements of the differently weighted picks can permit the musician to decide which pick to use to strike the strings of the instrument.

Other objects and advantages of the invention will become apparent from a study of the following portion of the specification, claims, and the attached drawings.

DETAILED DESCRIPTION OF THE BEST MODES FOR CARRYING OUT THE INVENTION

Figure 1:
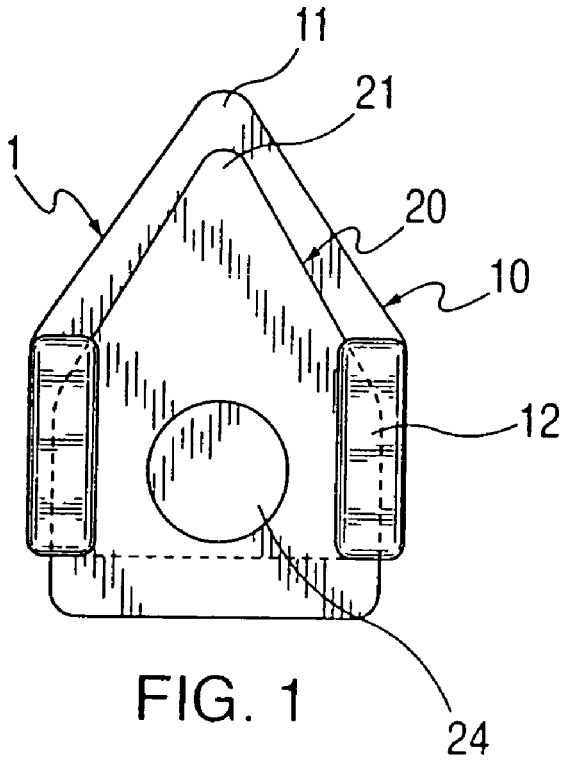
FIG. 1 is a top plan view of the multi-part pick of the present invention.
Figure 2:
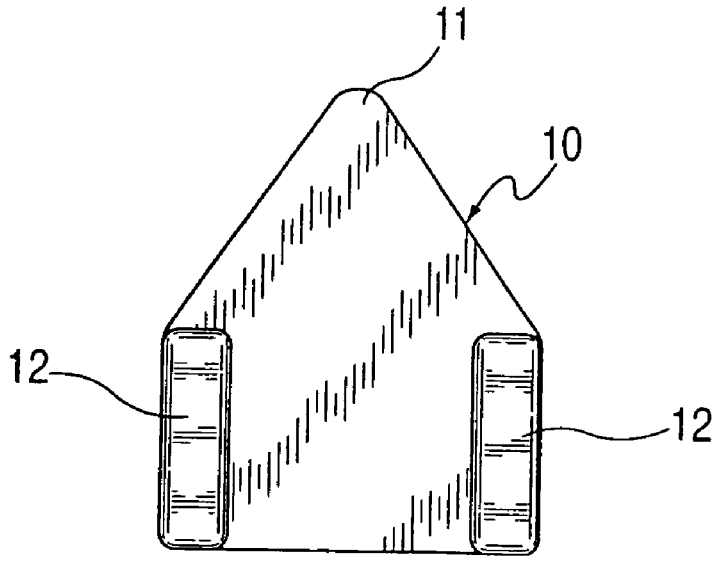
FIG. 2 is a top plan view of the first part 10 of the pick shown in FIG. 1.

Referring now in greater detail to the drawings, FIG. 1 shows an assembled multiple-part pick 1 according to the invention, the particular parts of which are described in more detail below with reference to the other drawing figures. FIG. 2 is a top plan view of the first part 10 of the pick shown in FIG. 1. FIG. 2 shows a generally five-sided first part 10 that includes, at the upper end of this view, a front portion in the form of a tapered rounded portion or blade 11 for picking or strumming the strings on a guitar or other stringed instrument. Formed on each side of the first part 10 is a web or flange 12 that extends upwardly from the top surface of the first part 10 and then extends inwardly over a portion of the top surface of the first part 10.

Figure 3:
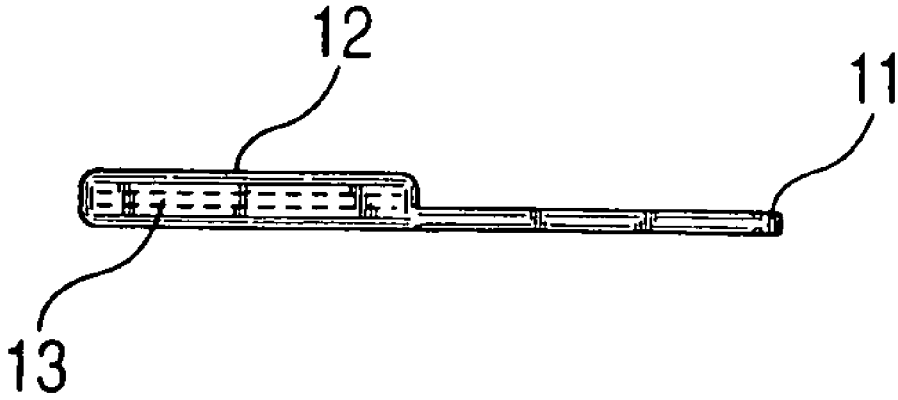
FIG. 3 is a side elevation view of the first part 10 in a first embodiment of the pick of the present invention.
Figure 4:
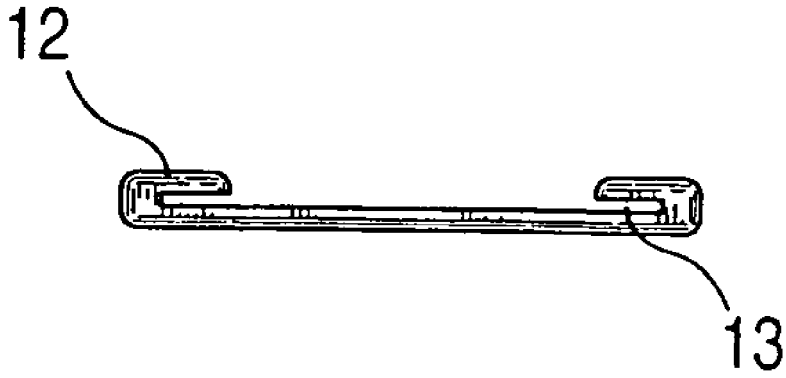
FIG. 4 is a rear elevation view of the first part 10 of the pick according to a first embodiment of the present invention.

As shown in FIGS. 3 and 4, a side elevation view and a rear elevation view, respectively, of the first part 10 of the pick before assembly, each of the flanges 12 forms a channel 13 between the flange's top surface and the top surface of the first part 10. The channels 13, 13 are thus formed and adapted for slidably receiving edges of the second part 20 of the pick 1 as will be described in connection with FIGS. 5 and 6. The channels 13, 13 formed by the flanges 12, 12 extend along parallel side edges of the first part 10 rearwardly of the front end or blade 11 of the first part 10, but the channels could be shorter or could simply be formed as or within a wall portion extending at an angle of 90° from the top surface of the first part 10 of the pick 1.

Obviously, the shape of the forwardly extending blade 11 used to strike the strings of the musical instruments could take various shapes without departing from the spirit and scope of the present invention. The material from which the first part 10 is formed could be any suitable pick material, such as plastic, that is adapted for engaging with the strings of a stringed musical instrument such as a guitar, banjo, mandolin, or the like.

Figure 5:
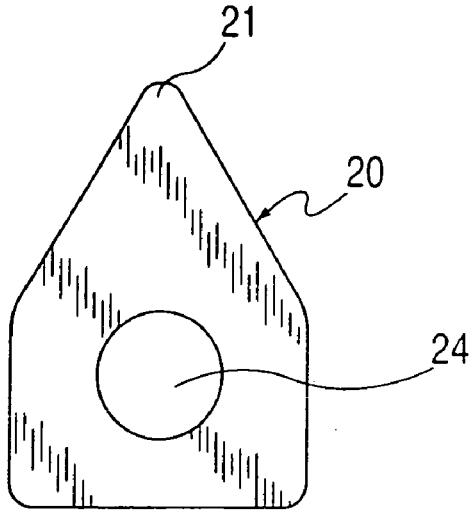
FIG. 5 is a top plan view of the second part 20 of the pick shown in FIG. 1.
Figure 6:
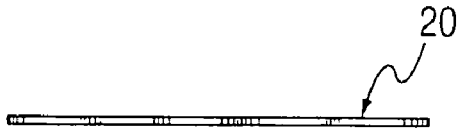
FIG. 6 is a side elevation view of the second part 20 of the pick shown in FIG. 1.

FIGS. 5 and 6 are top plan and side elevation views of a second part 20 of the pick 1 according to the invention. Second part 20 is a generally flat piece, generally similar in overall shape to the first part 10 except that, as shown in FIG. 6, second part 20 is generally flat and does not have any raised edges or flanges. For the convenience of the user, as shown in FIG. 5 and described in greater detail hereinafter, a circular aperture 24 is provided generally midway between the parallel side edges of the second portion 20, although the aperture 24 could take any shape to perform the function described below. At its upped end as shown in this figure, second part 20 has a tapered or rounded front portion or blade 21 for picking or strumming the strings on a guitar or other stringed instrument. The material from which the second part 20 is formed could be any suitable pick material, such as plastic, that is adapted for engaging with the strings of a stringed musical instrument such as a guitar, banjo, mandolin, or the like.

Figure 7:
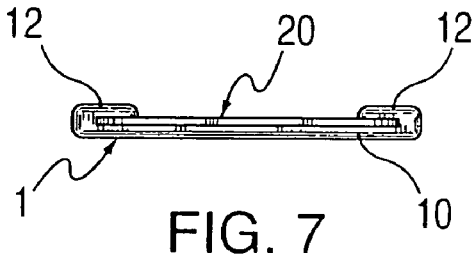
FIG. 7 is a rear elevation view of the assembled pick according to the first embodiment of the present invention.

FIG. 7 shows a rear elevation view of the first embodiment of the multiple-part pick 1 in its assembled condition. To assemble the multiple-part pick 1, the second part 20 is slidably inserted in the channels 13, 13 formed by the flanges 12, 12.

In order to use the pick 1 as disclosed, the musician picks up the assembled structure, as shown in FIG. 1, as with any normal pick. While the preference of the user may determine different types of uses, typically the pick 1 would be held between the thumb and the index finger of the hand used to play or strum the strings. The index finger can be appropriately placed in the aperture 24 so that relative movement between the first part 10 and second part 20 of the pick 1 can be accomplished simply by moving the fingertip of the finger in the aperture 24 relative to the thumb supporting the first part 10 of the pick 1. In this manner, the tapered front end or blade 21 of the second part 20 may be moved forwardly to extend past the tapered front end or blade 11 of the first part 10, so that the second part 20 of the pick, with the aperture 24 in the center, can then be used to engage the strings of the musical instrument. In this way, either the first part 10 or the second part 20 can be selectively chosen by the musician to contact the strings of the musical instrument. Because of the ease of use, a musician can switch between use of the first part 10 and the second part 20 quickly and easily, during the performance of a musical composition, for example. The parts 10 and 20 can be any convenient size for the musician.

A primary advantage of the multi-pick structure of the present invention is that the first and second parts 10 and 20 of the pick combination can be made of different types of material or different thicknesses so that the user can choose a varying combination according to his preference. For example, picks generally come in three "gauges" or "weights," heavy, medium, or light. The design of this invention allows a musician to change from one gauge pick or another in an instant using the thumb and index finger with a small sliding motion in an upward or downward direction without having to change grip. The multi-pick structure as disclosed, pairs a plurality of weights or gauges in any possible combination (heavy/light, medium/heavy, etc.) together, one on top of the other.

The aperture 24 on the second part 20 of the multi-pick structure offers maximum grip stability, and thus affords the guitarist a quick change in tone. The aperture 24 is optional, being designed primarily to provide the necessary grip or friction between the part 20 and the fingertip, and could be replaced by any size aperture or even ridges on the top of the second portion or indeed even a very rough surfaced design for maximum friction with the guitarist's fingers.

The multi-pick structure disclosed allows the guitarist easy change-over with the stability of pick alignment, since the parts are complementary in size so that there is no horizontal slipping relative to the vertical axis of sliding movement between the parts 10 and 20.

Figure 8:
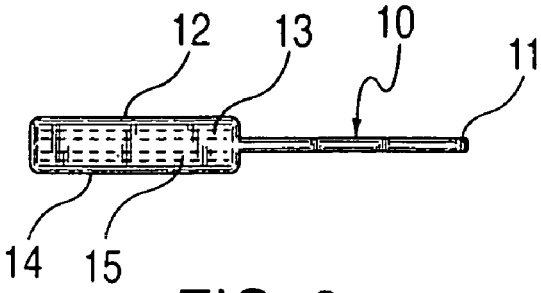
FIG. 8 is a side elevation view of the first part 10 of the pick according to a second embodiment of the present invention.
Figure 9:
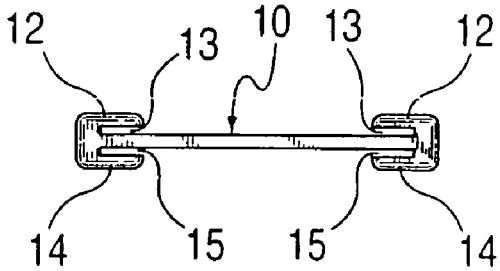
FIG. 9 is a rear elevation view of the first part 10 of the pick according to a second embodiment of the present invention.
Figure 10:
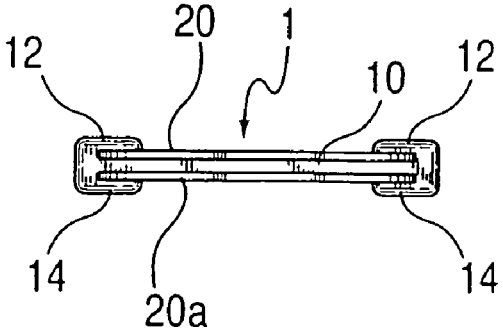
FIG. 10 is a rear elevation view of the assembled pick according to the second embodiment of the present invention.

In a second embodiment of the multiple-part pick 1 of the present invention, shown in particular in FIGS. 8-10, additional structures are provided to allow a third part 20*a* to be added on the side of the first part 10 opposite to the second part 20. This allows the musician to choose to use one or more of the blade 11 of first part 10, the blade 21 of the second part 20, and the blade of a third part 20*a*.

In this second embodiment, third part 20*a* is shaped similarly to second part 20, generally as shown in FIGS. 5-6, insofar as is necessary to be insertable and slidingly moveable in channels. Third part 20*a* also has a front end or blade, like part 20. However, third part 20*a* may be adapted to have features that differ from those of second part 20, for example, having a heavier or a lighter gauge or weight, having a different blade shape, or being formed of a different material.

As shown in FIGS. 8-9, in the second embodiment, a second set of flanges 14, 14 is added to the bottom side of the first part 10. The second set of flanges 14, 14 is positioned so as to form a second set of channels 15, 15. As shown in the view set forth in FIG. 9, the second set of channels is formed on the bottom side of the first part 10, opposite to the first set of channels 13, 13 formed on the top surface of the first part 10. As shown in FIG. 10, second part 20 is inserted into the channels 13, 13 formed above the top surface of first part 10, while third part 20*a* is inserted into channels 15, 15 formed below the bottom surface of first part 10. Thereby, the musician can, by application of thumb tip or fingertip force, slide forwardly of the blade 11 of the first part 10 one or more of the two blades of the second part 20 and the third part 20*a*, to position such blade(s) forwardly to contact the strings of the stringed instrument.

According to this example of the second embodiment, the musician has a choice of three blades with which to contact the strings of the instrument. The musician can quickly select and slide forward different blades to engage the strings. Assuming the blades of the first part 10, second part 20 and third part 20*a* each have different musical playing qualities, such as different gauges, shapes or materials, this configuration of the pick device allows the musician to change the sound quality of the performed musical tones, without interrupting the musical performance to change picks.

Figure 11:
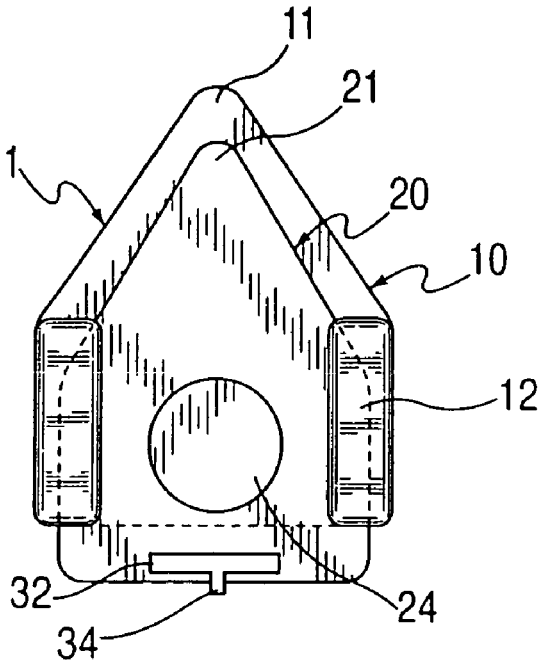
FIG. 11 is a top plan view of the multi-part pick with a holder part, according to a third embodiment of the present invention.
Figure 12:
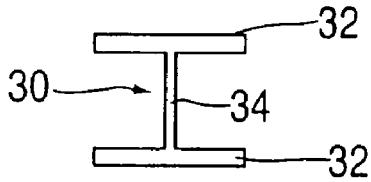
FIG. 12 is a top plan view of a flattened holder part of the multi-part pick according to the third embodiment of the present invention.
Figure 13:
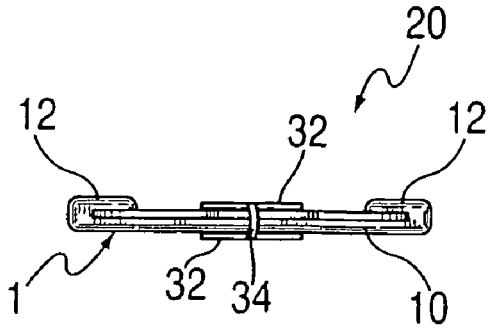
FIG. 13 is a rear elevation view of the assembled pick with the holder part, according to the third embodiment of the present invention.

In a third embodiment of the invention, an additional feature is added in order to flexibly secure the second part 20 and third part 20*a* to one another or to the first part 10, thereby keeping parts 20 or 20*a* from sliding too far out of the channels 13, 13 or 15, 15, respectively, or even from disengaging altogether from the other parts. An embodiment of the invention including this feature is shown in FIGS. 11-13.

According the this third embodiment, this additional feature is a fixed length flexible connector or holder 30, which can be formed of flexible and/or elastic material such as a polymer or a rubber like material. The holder 30 is shown separately from the other parts of the pick in FIG. 12. The holder has two tab portions 32, 32. As shown in the embodiment depicted in FIG. 13, one holder tab portion 32 is affixed to the first part 10, and the other holder tab portion 32 is affixed to the second part 20. These tab portions are affixed to the respective parts in any conventional matter, such as using glue or a two-sided adhesive strip, not shown. The affixation of the tab portions can be permanent or removable, the latter option offering the musician flexibility of choice in replacing the first part 10 or the second part 20 with a part having different music playing qualities.

The two holder tab portions 32, 32 are connected to one another via a strip portion 34, formed of a flexible and/or elastic material such as a polymer or rubber like material. In the embodiment shown in FIG. 13, the strip portion 34 keeps first part 10 connected to second part 20, so that second part 20 can neither slide too far forward toward the stringed instrument, nor slide too far back, and generally helps keep the second part from becoming completely disengaged from the first part 10 by sliding completely out of the channels. The length of the strip portion 34 can vary, but generally is to be long enough to allow second part 20 to slide freely forward into position to engage the strings of the instrument, and is to be short enough to keep the second part 20 from disengaging from the channels 13, 13 by sliding too far forward or backward.

If the holder feature is applied to the three-blade embodiment shown in FIGS. 8-10, the holder 30 would have its tab portions 32, 32 affixed respectively to second part 20 and third part 20*a*. This would serve to connect second part 20 and third part 20*a* via the strip portion 34. Thereby, there is also provided some security against disengagement of these parts from one another and from the first part 10, which is sandwiched between second part 20 and third part 20*a*. Optionally, in the second embodiment, the strip portion 34 could be connected at its midpoint to the back edge of the first part 10 in a conventional manner to prevent either the second part 20 or the third part 20*a* from disengaging from the channels 13, 13 or 15, 15.

Figure 14:
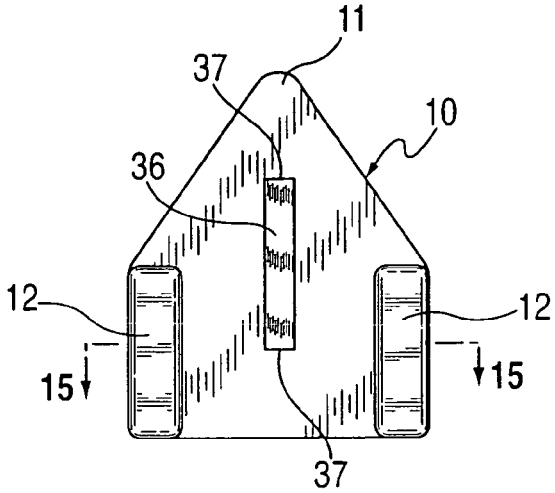
FIG. 14 is a top plan view of the first part 10 of the pick according to a fourth embodiment of the invention.
Figure 16:
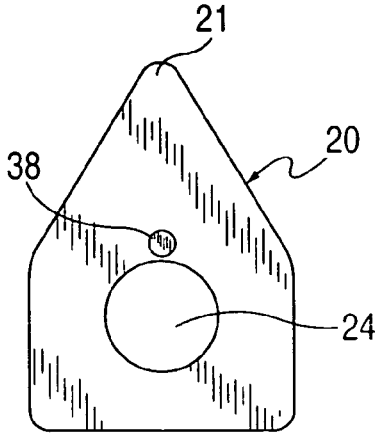
FIG. 16 is a bottom plan view of the second part 20 of the pick according to a fourth embodiment of the present invention.
Figure 15:
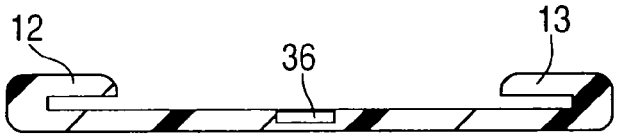
FIG. 15 is an enlarged cross-sectional view of the first part 10 of the pick according to a fourth embodiment of the present invention, taken along line 15-15 of FIG. 14.
Figure 17:
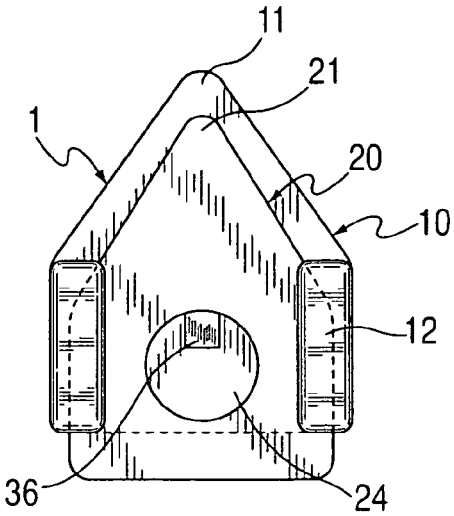
FIG. 17 is a top plan view of the assembled multi-part pick according to a fourth embodiment of the present invention.

A fourth embodiment of the multiple-part pick 1 of the present invention is shown in particular in FIGS. 14-17. As seen in FIG. 14, a slight depression, in the form of a generally rectangular-shaped slot or channel 36, is formed in the top surface of the first part 10 of the pick 1. FIG. 15 is an enlarged cross-sectional view along line 15-15 of FIG. 14. FIG. 15 shows that the slot or channel 36 does not extend all the way through the first part 10 of the pick 1. This channel 36 thus provides a track or depression within which can be guided a projection 38, in the nature of a peg or a post, that is formed on and projects from the bottom surface of the second part 20 of the pick 1, as shown in FIG. 16. The channel 36 is shaped to accept the peg 38. FIG. 17 shows the assembled multi-part pick 1 under this embodiment, with its first part 10 having the channel 36, within which the peg 38 (not visible in this view) of the second part 20 is seated.

During relative movement between the first part 10 and the second part 20 in an up or down direction from the position shown in FIG. 17, the peg 38 is seated within and is slidingly engaged within the channel 36. This movement is impelled by the movement of the musician's fingers or thumb, which slide the first part 10 and the second part 20 relative to one another. The sliding is stopped when the peg 38 reaches either the upper or lower ends 37, 37 of the channel 36. This provides a stable upper stop position and a stable lower stop position for the relative movement between the first part 10 and the second part 20. These stable stop positions keep the first part 10 and second part 20 from being accidentally disengaged, by preventing relative movement between first part 10 and second part 20 that extends so far that the second part 20 could disengage from the channels 13, 13.

Figure 18:
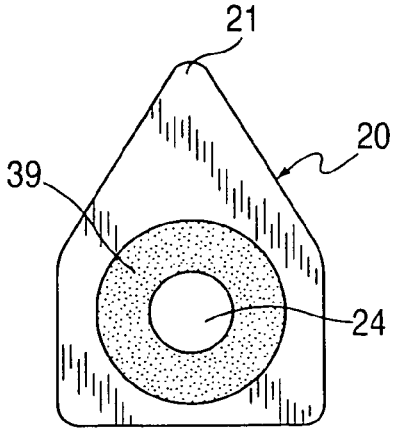
FIG. 18 is a top plan view of the second part 20 of the pick according to a fifth embodiment of the present invention.

In a fifth embodiment of the multi-part pick 1 according to the invention, a gripping portion 39 is provided on the top surface of the second part 20, in an area surrounding the aperture 24. This gripping portion 39, shown in FIG. 18, can also be added to the second part 20 under the other embodiments disclosed herein. The gripping portion is designed or composed in order to provide an area of higher-friction contact between the second part 20 and the fingers or thumb of the musician. The gripping portion 39 thus is designed and provided to lower the chance of slipping between the musician's fingers or thumb and the second part 20 of the pick. The gripping portion 39 can be provided in any manner that would offer a higher friction area, e.g., in the form of a roughened, scored, or textured part of the top surface of the second part 39, in the form of an added coating, adhesive, or decal layer applied onto the top surface, or in the form of a portion comprised of a material different from the remainder of the second part 20 and providing a higher coefficient of friction between the second part 20 and the musician's finger or thumb.

The foregoing detailed description has been given for clearness of understanding only, as it is apparent that other embodiments, shapes and modifications of the disclosed invention are possible without departing from the spirit and scope of the invention as defined in the appended claims.

INDUSTRIAL APPLICABILITY

The multiple pick structure for stringed instruments provides an improved pick for the player of a stringed musical instrument such as a guitar by allowing the musician to select from a plurality of weights, gauges, types, or shapes of picks without interrupting the musical performance in order to change picks.

The invention claimed is:

1. A multiple part pick for engaging strings of a stringed musical instrument, comprising;

a first part comprising a first blade adapted for engaging the strings of the stringed musical instrument;

a second part comprising a second blade adapted for engaging the strings of the stringed musical instrument; and a connection portion formed to slidably connect the first part with the second part for relative forward and backward sliding movement between the first part and the second part.

2. The multiple part pick according to claim 1, wherein the connection portion comprises a plurality of flanges formed on side edges of a first surface of the first part, said flanges being shaped to form a plurality of parallel channels along the side edges of the first surface of the first part, said channels being shaped to receive insertion of side edges of the second part.

3. The multiple part pick according to claim 1, wherein the second part further comprises a gripping portion for gripping said second part to actuate the relative movement between the first part and the second part.

4. The multiple part pick according to claim 3, wherein the gripping portion comprises an aperture shaped to receive partial insertion of a fingertip of a user of the pick.

5. The multiple part pick according to claim 3, wherein the gripping portion comprises a high friction area adapted to engage with a fingertip of a user of the pick.

6. The multiple part pick according to claim 4, wherein the gripping portion further comprises a higher-friction area positioned on the top surface of the second part in an area surrounding the aperture.

7. A multiple part pick for engaging strings of a stringed musical instrument, comprising:

a first part comprising a first blade adapted for engaging the strings of the stringed musical instrument;

a second part comprising a second blade adapted for engaging the strings of the stringed musical instrument;

a third part comprising a third blade adapted for engaging the strings of the stringed musical instrument;

a first connection portion formed to slidably connect the first part with the second part for relative movement between the first part and the second part; and a second connection portion formed to slidably connect the first part with the third part for relative movement between the first part and the third part.

8. The multiple part pick according to claim 7, wherein the first connection portion comprises a plurality of flanges formed on side edges of a first surface of the first part, said flanges being shaped to form a plurality of parallel channels along the side edges of the first surface of the first part, said channels being shaped to receive insertion of side edges of the second part; and the second connection portion comprises a plurality of flanges formed on side edges of a second surface of the first part, said flanges being shaped to form a plurality of parallel channels along the side edges of the second surface of the first part, said channels being shaped to receive insertion of side edges of the third part.

9. The multiple part pick according to claim 7, wherein the second part and the third part each further comprise a gripping portion for gripping said second and third parts to actuate the relative movement between the first part and the second part and third part, respectively.

10. The multiple part pick according to claim 9, wherein the gripping portion comprises an aperture shaped to receive partial insertion of a fingertip of a user of the pick.

11. The multiple part pick according to claim 9, wherein the gripping portion comprises a high friction area adapted to engage with a fingertip of a user of the pick.

12. A multiple part pick for engaging strings of a stringed musical instrument, comprising:

a first part comprising a first blade adapted for engaging the strings of the stringed musical instrument;

a second part comprising a second blade adapted for engaging the strings of the stringed musical instrument;

a connection portion formed to slidably connect the first part with the second part for relative movement between the first part and the second part;

and a flexible or elastic strip attached between the first part and the second part, which allows said slidable connection while preventing disengagement of the first part from the second part.

13. A multiple part pick for engaging strings of a stringed musical instrument, comprising:

a first part comprising a first blade adapted for engaging the strings of the stringed musical instrument;

a second part comprising a second blade adapted for engaging the strings of the stringed musical instrument;

a third part comprising a third blade adapted for engaging the strings of the stringed musical instrument;

a first connection portion formed to slidably connect the first part with the second part for relative movement between the first part and the second part;

a second connection portion formed to slidably connect the first part with the third part for relative movement between the first part and the third part; and and a flexible or elastic strip attached between the second part and the third part, which allows said slidable connections while preventing disengagement of the second part from the third part.

* * * * *